United States Patent [19]

Chen

[11] 4,211,188

[45] Jul. 8, 1980

[54] METHODS AND APPARATUS FOR FEEDING LIQUID INTO APPARATUS HAVING HIGH PRESSURE RESISTANCE

[76] Inventor: Thomas Y. C. Chen, 5509 King Arthur Ct., Westmont, Ill. 60559

[21] Appl. No.: 23,334

[22] Filed: Mar. 23, 1979

Related U.S. Application Data

[63] Continuation-in-part of Ser. No. 841,490, Oct. 12, 1977, Pat. No. 4,165,718.

[51] Int. Cl.[2] ..... F22D 5/28

[52] U.S. Cl. ..... 122/451 R; 122/456; 122/458

[58] Field of Search ..... 122/451 R, 452, 456, 122/457, 458

[56] References Cited

U.S. PATENT DOCUMENTS

| | | | |
|---|---|---|---|
| 759,660 | 5/1904 | Brazda | 122/457 |
| 977,841 | 12/1910 | Rollins | 122/456 |
| 2,011,626 | 8/1935 | Goff | 122/456 X |
| 2,325,241 | 7/1943 | Gilmore | 122/456 |
| 2,870,751 | 1/1959 | Kuljian et al. | 122/451 R |
| 3,116,876 | 1/1964 | Palm | 122/456 X |

*Primary Examiner*—Edward G. Favors

*Attorney, Agent, or Firm*—Hill, Van Santen, Steadman, Chiara & Simpson

[57] ABSTRACT

Mechanical methods for reducing drastically the energy consumption of high pressure liquid pumping and for eliminating the use of expensive multi-tube heat exchangers.

The basic method is to utilize high pressure vapor at the suction side of the pump to reduce the required pumping pressure head. The energy content of the high pressure vapor is returned or utilized. Additional methods are provided to reduce energy requirement for transferring liquid to vapor generator, apparatus located at high elevation and apparatus having high pressure resistance.

63 Claims, 16 Drawing Figures

METHODS AND APPARATUS FOR FEEDING LIQUID INTO APPARATUS HAVING HIGH PRESSURE RESISTANCE

This application is a continuation-in-part of my pending application Ser. No. 841,490 filed Oct. 12, 1977, now U.S. Pat. No. 4,165,718 dated Aug. 28, 1979.

This invention relates to methods and apparatus for feeding liquid to high pressure apparatus such as a vapor generator, heat exchangers, and the like, and for transfer of liquid to high pressure apparatus with low energy consumption.

There are basically only two ways to solve the current energy crisis. The first is to increase energy sources, and the second is to reduce energy consumption. This invention is concerned with practical applications of the latter.

An object of this invention is to reduce greatly the power used to pump the condensate to the high pressure vapor generator by utilizing the techniques herein disclosed.

Another object is to save the high pressure extraction vapor used for condensate heating in the traditional practice in a power plant and replace it by superheating vapor of relatively much lower temperature and pressure, and thus the high pressure vapor can be utilized for energy generating to increase the efficiency of a power plant.

Another object is to isolate the condensate of less than 12 psia and to cause the condensate to condense vapor of various pressures in stages. It preserves the energy content of the vapor condensed and increases the vapor pressure of the condensate and thus reduces the pumping energy to pump the condensate to a condensate tank.

Another object is to transfer liquid that requires heating by utilizing the heating energy as motive force or power and thus effect substantial savings in energy required to transfer the liquid.

Other objects, uses, and advantages will be obvious or apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of modifications that will be obvious to those skilled in the art, and that are intended to be covered by the appended claims.

Figure 1:
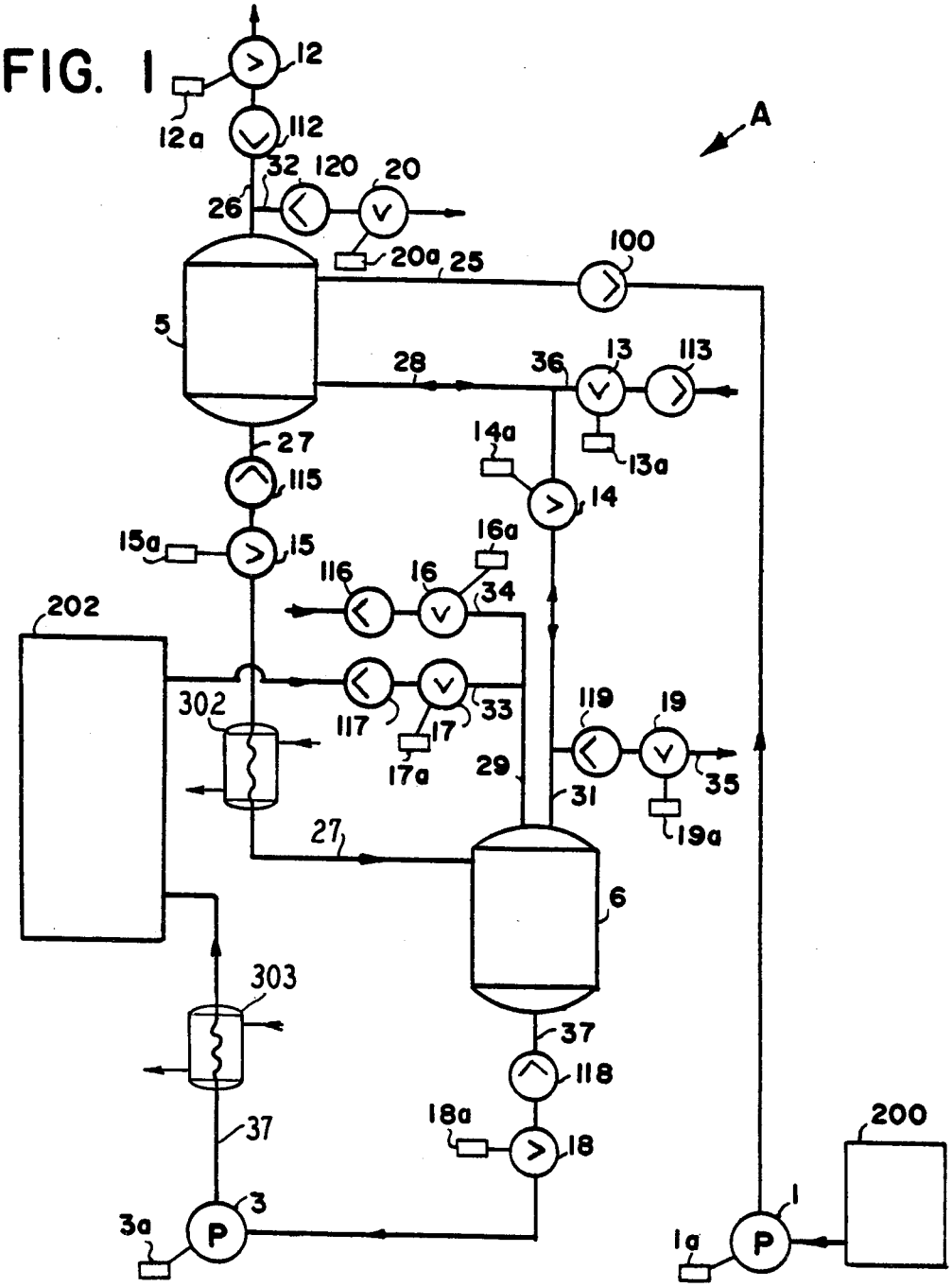
FIG. 1 is a diagrammatic representation of an energy saving condensate feeding system in accordance with the invention.

Referring to FIG. 1, the condensate feeding system A of this embodiment comprises condensate receivers 5 and 6 that are constructed in pressure vessel form from suitable material, such as steel, that will withstand internal pressures of up to 8,000 psig., depending upon the operating pressure. In situations where the quantity of oxygen in the processed fluid is enough to cause rust, stainless steel having a thickness in the range of from approximately ⅛th inch to approximately ½ inch can be used at all wetted parts of the receivers or vessels, as well as the inner surfaces of the piping employed in connection with the same. Stainless steel piping and fittings can be used wherever it is financially feasible. All valves, except check valves, shown in FIGS. 1, 5 through 9, and 10 are of the gradually opened automatic type. Other automatic or manual valves can be employed in parallel with any such automatic valve as a standby valve in case of emergency. One shut off valve shall be installed at each side of an automatic valve.

A condensate feed line 25 connects to the receiver 5 near its top and contains a check valve 100. A pump 1 in the feed line 25 is operative to pump condensate to the receiver 5 from a suitable source, such as vessel 200 (the condensate in vessel 200 being supplied, for instance, from steam operated turbines utilizing system A).

A vent line 26 extends upwardly from the top of the receiver 5 and contains a check valve 112 and a shut off valve 12. A branch line 32 extends from the line 26 to make available processing vapor for external work. The line 32 contains a shut off valve 20 and a check valve 120. The check valves 112 and 120 prevent fluid flow back into the vessel 5. A condensate discharge line 27 leads from the bottom of the receiver 5 (at fitting 27A, see FIG. 2) to the receiver 6 near the top thereof for feeding condensate into receiver 6. The line 27 contains a shut off valve 15, a check valve 115, and a heat exchanger 302. Fluid (vapor, condensate, or both), inlet line 29 connects to the top of the receiver 6 and discharges into a distributor means which will be described hereinafter. The line 29 is supplied with fluid either from vapor generator 202 (represented by square) through the line 33 or with heating fluid through the line 34. These lines contain the respective shut off valves 16, 17, and check valves 116, 117, respectively.

A vapor discharge line 31 extends upwardly from the top of the receiver 6 for carrying vapor to the line 28. The line 31 contains shut off valve 14. The line 28 connects to receiver 5 near the bottom of same and serves to provide a way to equalize the pressures between receivers 5 and 6.

A branch line 35 extending from the line 31 serves as a source to supply vapor from receiver 6 to other processing equipment. Line 35 contains shut off valve 19 and check valve 119. Line 28 extends outwardly, as at 36, from the point where it connects line 31; line 36 connects to a source of heating fluid which may be vapor, condensate or a mixture of both (such source can be a turbine discharge in some cases). Line 36 extends from line 28 and contains shut off valve 13 and check valve 113 which permits flow only in the direction toward the receiver 5 from the indicated source of heating fluid.

Each of the lines 34, 35 and 36 for purposes of disclosure is intended to represent one fluid pipe or multiple fluid pipes in parallel, and each of the said multiple pipes are to contain a shut off valve and a check valve identical to those shown for the respective lines 34, 35 and 36.

Line 37 extends from the bottom of the receiver 6 (as from fitting 37*a*, FIG. 2) to pump 3, which pumps condensate from the receiver 6 to the heat exchanger 303 and to force the heated condensate in the heat exchanger into the vapor generator 202. Line 37 contains shut off valve 18, check valve 118 and heat exchanger 303.

Figure 2:
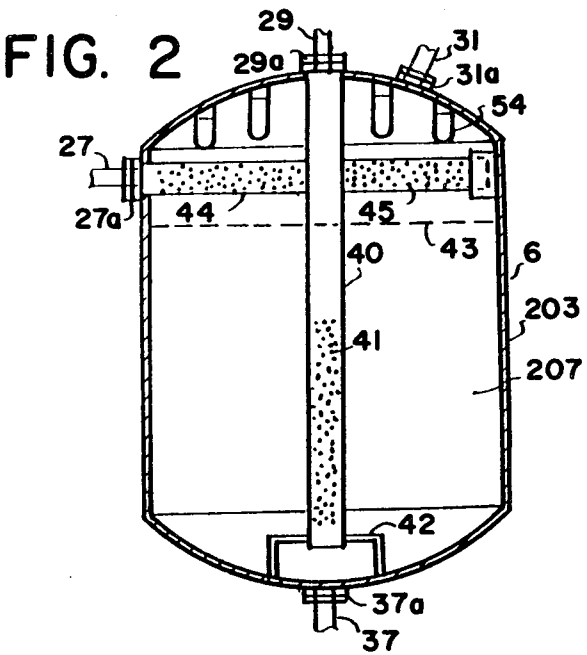
FIG. 2 is a diagrammatic elevational and sectional view of one of the basic energy saving condensate receivers which is usually connected to the last feeding pump, in accordance with the invention.

Referring now to FIG. 2, which shows a detailed section through the receiver 6, it will be noted that the line 29 connects at fitting 29*a* to a vertically disposed distributor tube 40 having multiple openings 41 in the lower part of same. The lower end of the tube 40 is sealed and secured to the bottom of the vessel forming receiver 6 by means of suitable supports 42. The primary liquid level, indicated at 43, represents the lowest level to which the vessel or receiver 6 is to be filled with condensate. The line 31 (FIG. 1) connects with fitting 31*a* of the receiver 6, and the fitting 37*a* at the bottom of receiver 6 connects with line 37 (FIG. 1). A distributor 44 extends horizontally across the receiver 6 at the upper part of same and connects to the line 27 through the fitting 27*a*. Each of all said fittings is a fitting of an opening of the shell 203. The distributor 44 is in the form of tube 44*a* having a multiplicity of holes 45 formed in same about its circumference, within receiver 6.

Figure 4A:
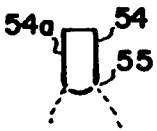
FIG. 4A is a diagrammatic sectional view taken substantially along line 4A—4A of FIG. 4.

The receiver 6 also has affixed to its upper end one or more sprinkler devices 54 (see FIGS. 2, 4 and 4A); and each device 54 comprises a trough 54*a* having a multiplicity of holes 55 formed in and along the lower portion of same through which condensate supplied to sprinkler 54 is to flow by gravity to condense heating vapor above level 43 in order to reduce the vapor pressure in vessel 6. The troughs 54*a* extend across the receiver and have their ends 56 suitably affixed to the receiver so that all condensate supplied to same drains out through holes 55. Condensate is supplied to the troughs 54*a* by their receiving condensate sprayed upwardly through distributor 44 when condensate is forced to distributor 44. Alternately, troughs 54*a* may be replaced by tubes or containers connected to an opening in the receiver shell. The tubes or containers may have vent openings at the top and multiple holes at the bottom for sprinkling. The sprinklers can be made of aluminum or stainless steel to meet the requirement of each application. A pump can be used for the sprinklers.

The distributor tubes 40 and 44 are made of stainless steel or extra hard tungsten alloy or equivalents so that they will adequately handle any pressurized fluid passing through the openings of same. They may be suitable fixed within the vessel 6 in their indicated positions. All parts inside the receiver should be so fastened to the wall of same in such a way that maximum expansion can be absorbed without causing any damage. The horizontal tube type distributor 44 can be supported by a larger drainable tube welded to the said wall. The end of the distributor is inside said drainable tube for free expansion. It is important that the outlet openings 41 in the distributor 40 be located below the primary liquid level 43 of the condensate in the receiver 6. Receiver 6 may contain two or more such distributors 40, as desired. The distributors 40 and 44 are arranged so that the only outlet for the vapor supplied to the receiver is through the openings 41 and 45.

Receiver 6 is basically defined by encompassing wall structure 203 suitably sealed and reinforced to withstand the operating pressure of any particular case.

The receiver 5 (FIG. 3) has at least a pair of horizontally disposed vertically spaced, tubular distributors 46 and 48 that contain openings 47 and 49 respectively distributed along the entire length of the respective distributor tubes 46 and 48 within receiver 5. The distributor tube 46, which is of the same general type as distributor 44 (FIG. 2), is connected with line 25 through fitting 25*a*. Distributor 48 located adjacent the bottom of the vessel forming receiver 5 is a tube similar to distributor 44 and is connected with the line 28 through the fitting 28*a*. Line 26 is connected with the fitting 26*a* at the top of receiver 5, and the line 27 is connected with the fitting 27*a* at the bottom of receiver 5. Receiver 5 is also equipped with one or more of the sprinkler devices 54 that are operably associated with distributor 46 in the same manner as with distributor 44 of receiver 6.

Receiver 5, like receiver 6, is basically defined by encompassing wall structure 205 suitably sealed and reinforced to withstand the operating conditions contemplated by and particular application. Thermal insulation is required outside the wall 205.

Figure 3:
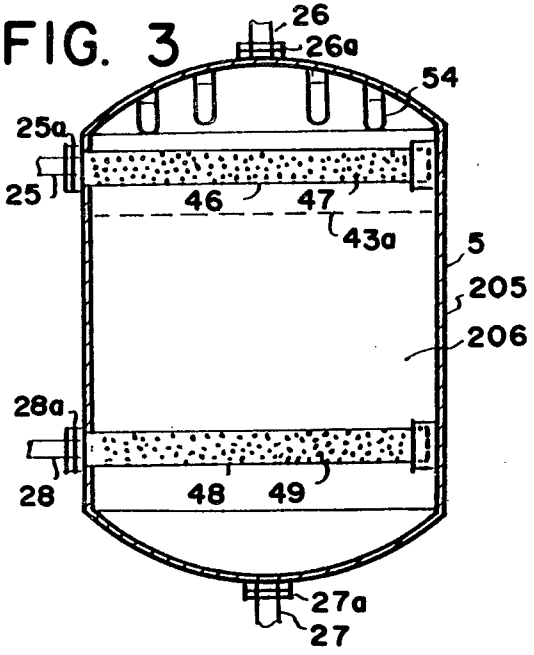
FIG. 3 is a view similar to that of FIG. 2 illustrating the other basic energy saving condensate receiver used in accordance with the invention.

It will be apparent that the vapor and condensate distributors shown in FIGS. 2 and 3 may be of other suitable distributing shapes that will effect adequate dispensing of the fluids involved within the respective vessels for purposes of condensing the vapor in same.

Figure 5:
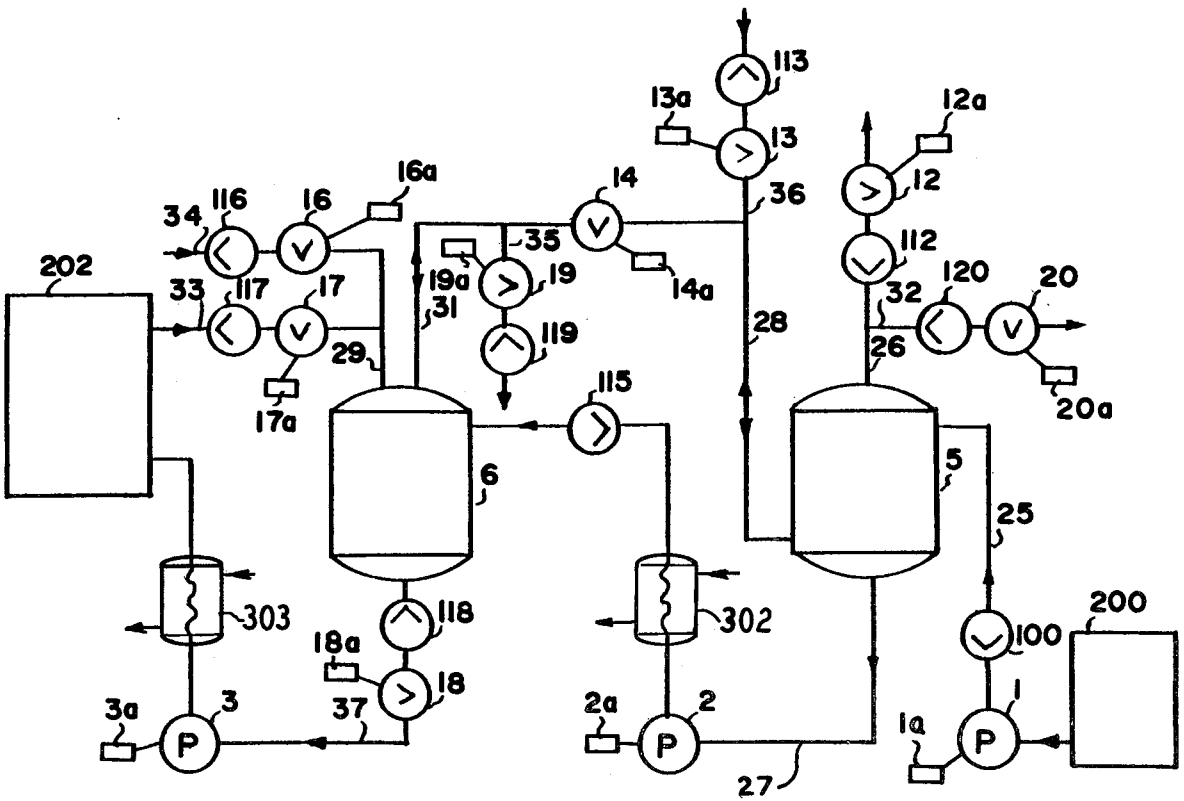
FIG. 5 is a view similar to that of FIG. 1 showing a modified arrangement of the embodiment of FIG. 1.
Figure 5A:
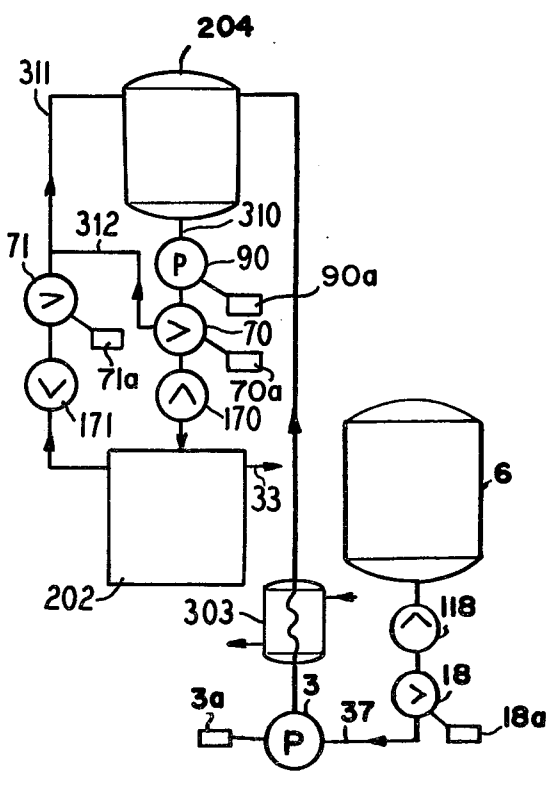
FIG. 5A is a fragmental view showing a variation in the embodiment of FIG. 5.

Referring to FIG. 5*a*, it shows that line 37 contains an additional pressure vessel 204, pump 90, valve 70, and check valve 170, downstream of heat exchanger 303. A vapor balance line 311 extends from vapor generator 202 to pressure vessel 204. Line 311 contains valve 71 and check valve 171. Line 312 extends from the three-way valve 70 to line 311.

Figure 5C:
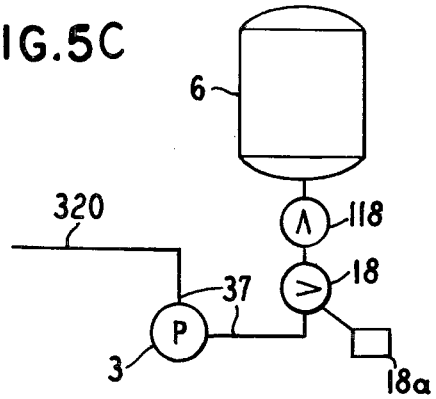
FIG. 5C is a fragmental schematic view showing a third modification of the embodiment of FIG. 5.
Figure 5B:
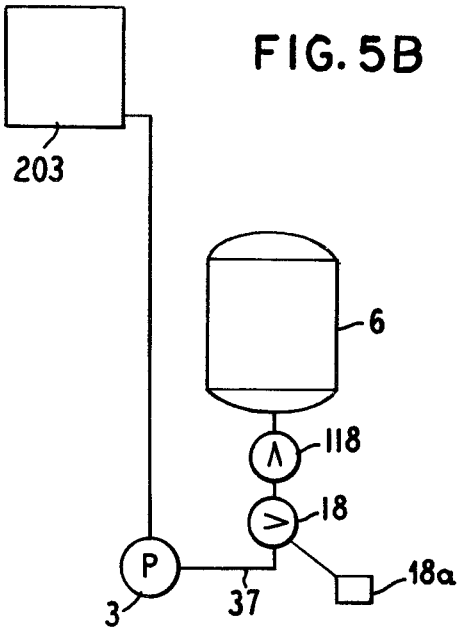
FIG. 5B is a fragmental schematic view showing a second modification of the embodiment of FIG. 5.

Referring to FIG. 5*b*, it shows that line 37 extends to an elevated apparatus with internal high vapor pressure (or a liquid receiver), 203, instead of the generator 202, as shown.

Referring to FIG. 5C, it shows that line 37 extends to a pipe line 320 instead of generator 202.

Figure 6:
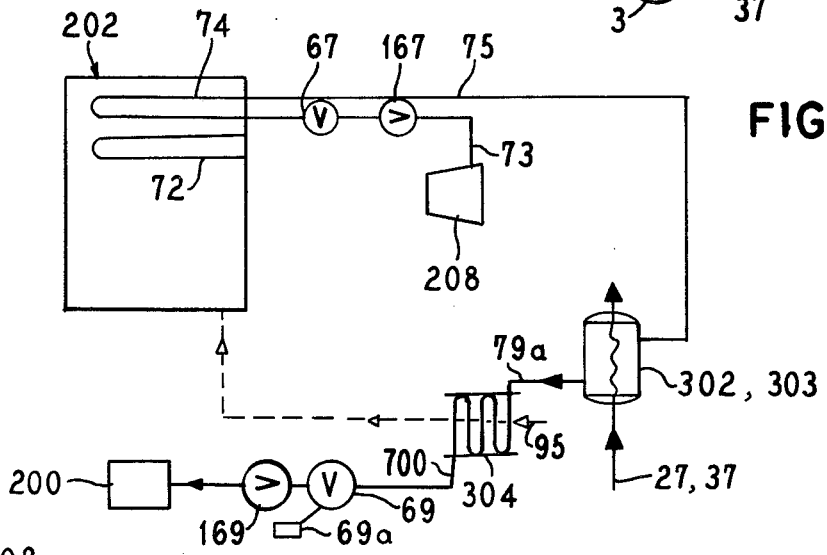
FIG. 6 is a fragmental diagrammatic representation of means for an energy saving method of superheating vapor for condensate heating.

Referring to FIG. 6, a conventional vapor reheat tube 72 is in boiler 202. Line 73 extends from turbine 208 to a reheat tube 74 and it contains a valve 67 and a check valve 167. Line 75 extends from the tube 74 to heat exchanger 302 or 303. Line 79*a* extends from the heat exchanger to heating coil 304. Tube 74 is located downstream from tube 72 in relation to the heat flue in the boiler.

Line 700 extends from coil 304 to tank 200, and it contains valve 69 and check valve 169.

Figure 7:
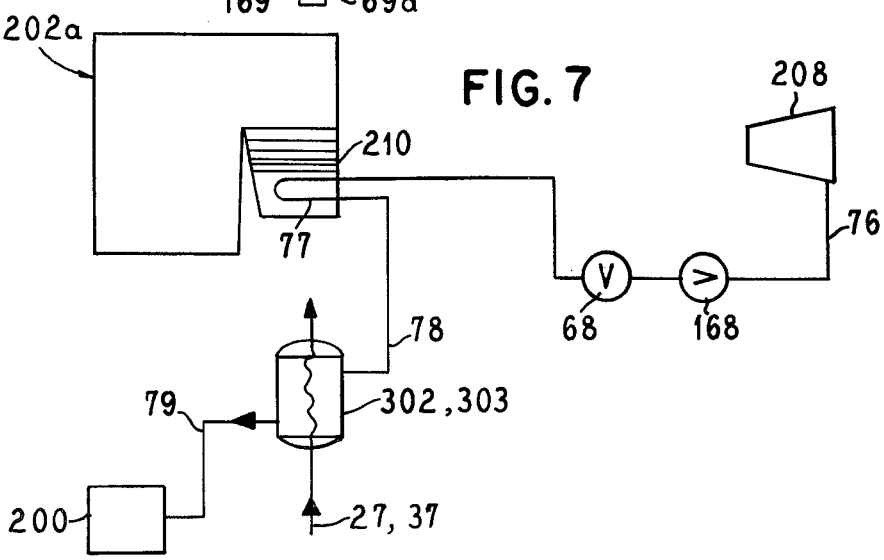
FIG. 7 is a view similar to that of FIG. 6, showing a modified arrangement of the embodiment of FIG. 6.

Referring to FIG. 7, it shows a similar system as shown in FIG. 6. Line 76 extends from turbine 208 to reheat tube 77 in boiler 202*a* and line 76 has a valve 68 and a check valve 168. Line 78 extends from tube 77 to heat exchanger 302 or 303. Line 79 extends from the heat exchanger to tank 200.

Figure 10:
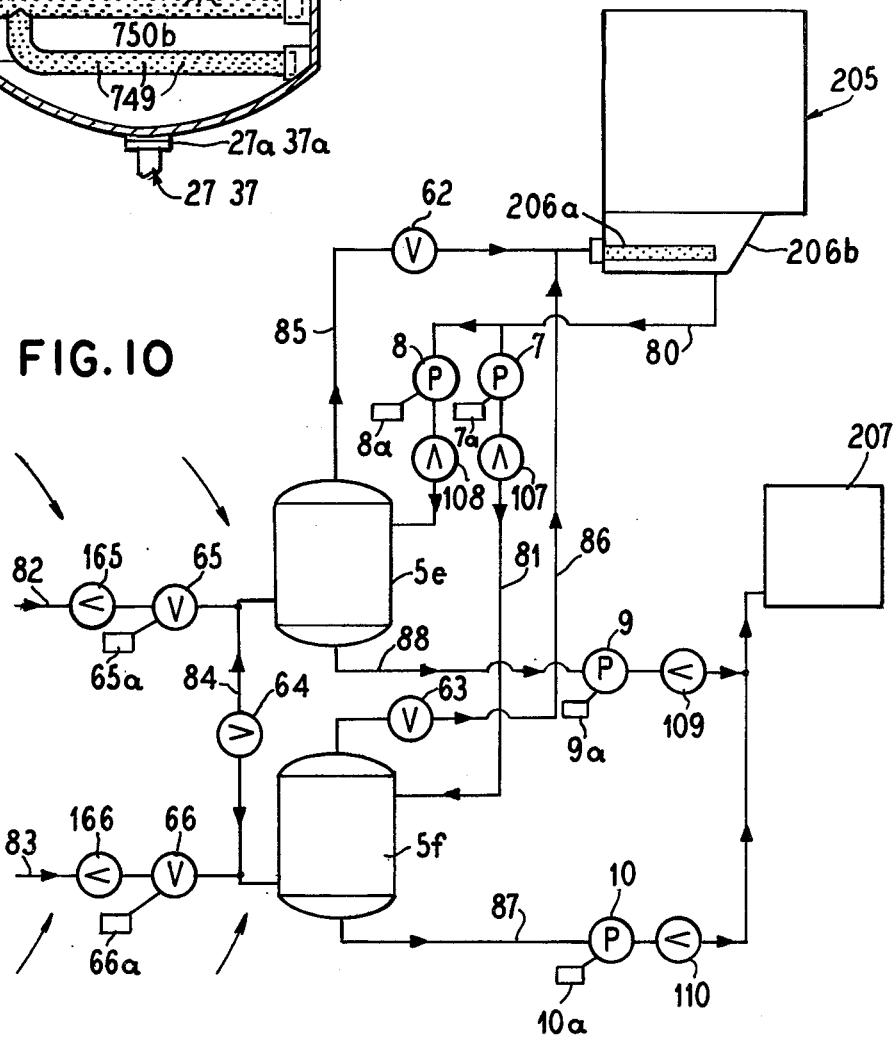
FIG. 10 is a diagrammatic representation of another energy saving condensate heating and pumping system in accordance with the invention.

Referring to FIG. 10, the condensate sump 206*b* is connected to the bottom of condenser 205 and the vapor distributor 206*a* with multiple openings is located in the sump. Line 80 extends from sump 206*b* to receiver 5*e*, and has a pump 8 and a check valve 108. Line 81 extends from line 80 (upstream from valve 8) to receiver 5*f*, and it has a pump 7 and a check valve 107. Line 84 is connected to a vapor distributor in both receiver 5*e* and 5*f*. Line 84 has a valve 64. Line 82 is connected to a vapor source and extends to line 84. Line 82 contains valve 65 and check valve 165. Line 83 is connected to a vapor source and extends to line 84. Line 83 contains valve 66 and check valve 166. Line 85 extends from the top of receiver 5*e* to distributor 206*a* and contains valve 62. Line 86 extends from the top of receiver 5*f* to line 85 (downstream from valve 62). Line 87 extends from the bottom of receiver 5*f* to apparatus 207 and contains pump 10 and check valve 110. Apparatus 207 may be a deaerating tank. Line 88 extends from the bottom of receiver 5*e* to line 87 (downstream from valve 110 and pump 10), and has pump 9 and check valve 109.

Each of the lines 82,83 for purpose of disclosure is intended to represent one fluid pipe or multiple fluid pipes in parallel and each of the said multiple pipes has a shut-off valve, identical to those shown for the respective line.

In operating the system shown in FIG. 1, the condensate accumulating in the equipment involved (for instance, a condensate tank), represented by vessel 200, and which is to be supplied to the vapor generator 202, is pumped by the pump 1 from the vessel 200 through the line 25 into the distributor 46 of receiver 5. The condensate passes through the distributor openings 47 into the chamber 206 defined by wall structure 205 to fill the vessel 5 up to the primary liquid level 43*a*. An automatic air vent arrangement of a suitable type is provided for receivers 5 and 6; same air vents are arranged to automatically release the air contained within the receivers 5 and 6 when the receiver involved is being charged with condensate in the first operating cycle. This may be done in any suitable manner. After the first cycle the receiver 5 is filled with vapor and then the receiver 5 is charged with condensate. The relatively cooler condensate shall cool the vapor through the distribution of distributor 46, and thus both the vapor pressure in the receiver and the pumping energy consumption are reduced.

When the liquid level 43*a* is reached in receiver 5, pumping is discontinued, and this may be achieved by employing a timer or suitable sensing device 1*a* which operates to discontinue the pumping action of the punp 1 when the level 43*a* is reached.

The heating fluid which may be steam at 270 degrees F., is introduced into the condensate now within the vessel 5 through line 28 and the perforated tube 48, and valve 13 is closed. The temperature of the condensate within receiver 5 will thereby be raised for example from approximately 180 degrees F. to approximately 230 degrees F. During the filling of the receiver 5 and the heating of the condensate, the valves 12 and 20 are closed so that no liquid or vapor escapes from the receiver 5. The valve 12 is opened briefly (about two to four seconds) to release to the atmosphere air trapped in receiver 5, when the condensate reaches approximately 230 degrees F.

After the condensate of receiver 5 has been heated to approximately the temperature level indicated and trapped air has been released, valve 14 is opened to balance the pressures of receivers 5 and 6 (except for the first operating cycle of the system, there is high pressure steam remaining in receiver 6 from the previous cycle); the valve 15 is opened, and the condensate flows by gravity from the receiver 5 through line 27 into heat exchanger 302 to force the heated condensate, which may be, for example, of approximately 300° F. in the heat exchanger into receiver 6, and specifically, through its distributor 44. The condensate is discharged through the distributor openings 45 into the chamber 207 defined by wall structure 203 of receiver 6. During the flow of condensate through the line 27, the valve 14 of line 31 is opened so that the pressure of receivers 5 and 6 remains equalized. After the condensate in receiver 6 reaches the level indicated at 43, the receiver 6 is isolated from receiver 5 by closing the valves 14 and 15. Heating fluid, for example, in the form of steam at approximately 400 degrees F. is then introduced into the condensate in receiver 6 through lines 34 and 29, by opening valve 16, and it discharges into said receiver 6 through its tube 40 and its openings 41. By this procedure the temperature of the condensate in vessel 6 is raised, for example, from approximately 300 degrees F. to approximately 380 degrees F. During this period the valve 17, 18 and 19 remain closed.

Valve 20 may be opened to release vapor from receiver 5 for outside processing after said receiver is drained. This reduces the pressure inside receiver 5, and thus reduces the power requirements of pump 1.

To equalize the vapor pressure between the vapor generator 202 and the receiver 6, vapor from the vapor generator 202 is bled into the line 33 by opening valve 17. This high pressure vapor passes into tube 40 and is discharged through the openings 41 in the tube 40 and imposes on the condensate in vessel 6 a pressure approximately equal to that existing within the vapor generator.

It is understood that the high pressure vapor is not limited by its source. It can be bled from any adequate source, and it can be bled into the receiver without passing through a distributor to impose a vapor pressure in said receiver.

It is now possible to pump the heated condensate from the vessel 6 to the heat exchanger 303 to force the heated condensate of approximately 550° F. into the vapor generator 202. At this point, the valve 18 is opened and the pump 3 is actuated to pump the condensate into the heat exchanger 303.

After the receiver 6 has been drained, valves 17 and 18 are closed and the valve 19 may be opened to release vapor from the receiver 6 for external work of any useful character.

System A as shown in FIG. 1 may be operated in continuously repeating cycles of the type indicated to convey condensate from the receiver 200 to vapor generator 202. Lines 35 and 32 and the related valves can be omitted in some cases.

Any of the heat exchangers and any of the heating steps for utilizing heating fluid can be omitted in some cases.

Figure 4:
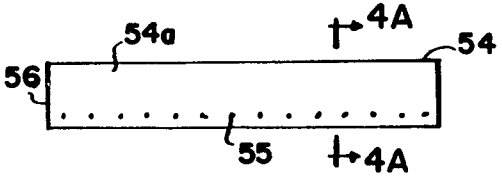
FIG. 4 is a fragmental elevational view of a liquid fluid sprinkling arrangement employed in the receivers of FIGS. 2, 3 and 11.

Referring now to FIG. 5, a system B is illustrated that is similar to system A except that a pump 2 is utilized in the line 27 to replace the shut off valve 15. This facilitates moving the condensate from the receiver 5 to receiver 6 at a faster rate than that afforded by gravity. The reference numerals of FIG. 5 that are identical to those of FIGS. 1 to 4 indicate like parts. FIG. 5A shows that pump 3 pumps the condensate to pressure vessel 204 directly or indirectly and said condensate is charged from vessel 204 to the generator. It can be so arranged that speed of condensate charging into the generator 202 is almost constant, by adequately sizing the vessel 204.

Figure 11:
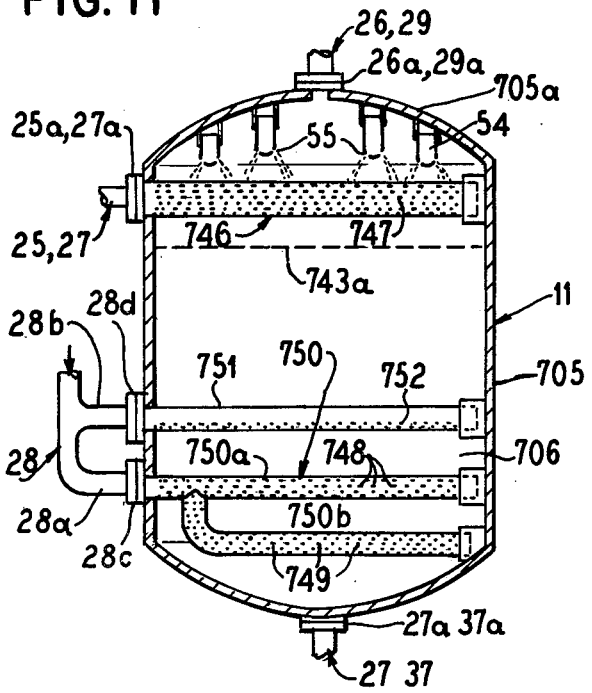
FIG. 11 is a view similar to FIG. 3, and illustrates another basic energy saving condensate receiver, in accordance with the invention.

Any of the receivers 5 or 6 can be replaced by the receiver 11 shown in FIG. 11. The condensate distributor in any of the receivers can be omitted in some cases.

The operation of the system is not only for feeding condensate into a vapor generator. It can also be used to feed liquid into an elevated apparatus or an apparatus with substantial pressure resistance.

FIGS. 5, 5B show that pump 3 pumps liquid into an elevated apparatus 203 with substantial pressure reistance. In a case, for example, pump 3 may pump crude oil into a crude oil tank with 50 psig internal pressure and the tank may be 70 feet above the pump. Receiver 6 is filled with the vapor of petroleum of approximately 80 psig pressure and the vapor is released from a petroleum heater. Pump 1 pumps crude oil of 60° F. into receiver 5, up to a primary liquid level. Valve 14 is open to release the vapor in receiver 6 into receiver 5 through a vapor distributor to inject the vapor into the crude oil and the oil is heated to approximately 80° F. Pump 2 pumps the oil in receiver 5 into receiver 6 until receiver 5 is drained. Valve 16 is opened to release the petroleum vapor of 80 psig from the heater into receiver 6 for assisting pump 3 to pump the oil from receiver 6 to the apparatus 203, and thus the energy requirement for pump 3 is drastically reduced. Pump 3 can be omitted when the pressure of the high pressure vapor released into receiver 6 is high enough to force the condensate or liquid in receiver 6 into vapor generator 202 or apparatus 203. If the required pressure head of pump 3 is 2,500 psig (FIG. 5) the pump can be omitted by releasing 2700 psig vapor into receiver 6 in many cases.

The systems shown in FIGS. 1, 5, **5*b*, 5*c*** can also be used in medium and low pressure apparatus and systems. It is not limited in high pressure apparatus and operations in this disclosure.

The receiver 5 can be located lower than or at the same level as the receiver 6, if the vapor released into the receiver 5 through the valve 13 can impose enough pressure in receiver 5 to force the condensate therein into receiver 6.

FIGS. 5, 5C show that the pump 3 pumps liquid (for example, crude oil) into a long extended piping 320. The high pressure vapor released into receiver 6 can be petroleum vapor or steam vapor. The vapor heats the crude oil in both receivers 5 and 6 and the heated oil will have a relatively lower friction resistance in the pipe and thus reduce pumping energy. Pump 3 can be omitted when the vapor pressure in the receiver 6 is high enough to push the liquid in the receiver into the pipe line. For example, in a case, the total pipe line resistance is 90 psig, pump 3 pumps the liquid in the receiver 6 with little energy by releasing petroleum vapor of 80 psig into receiver 6 while pumping. If 100 psig vapor is released into receiver 6, pump 3 can be omitted, valve 18 is in control of the operation. Apart from these differences, the operation of the apparatus shown in FIGS. 5, 5C is the same as that described for the apparatus shown in FIGS. 5, 5B.

Figure 8:
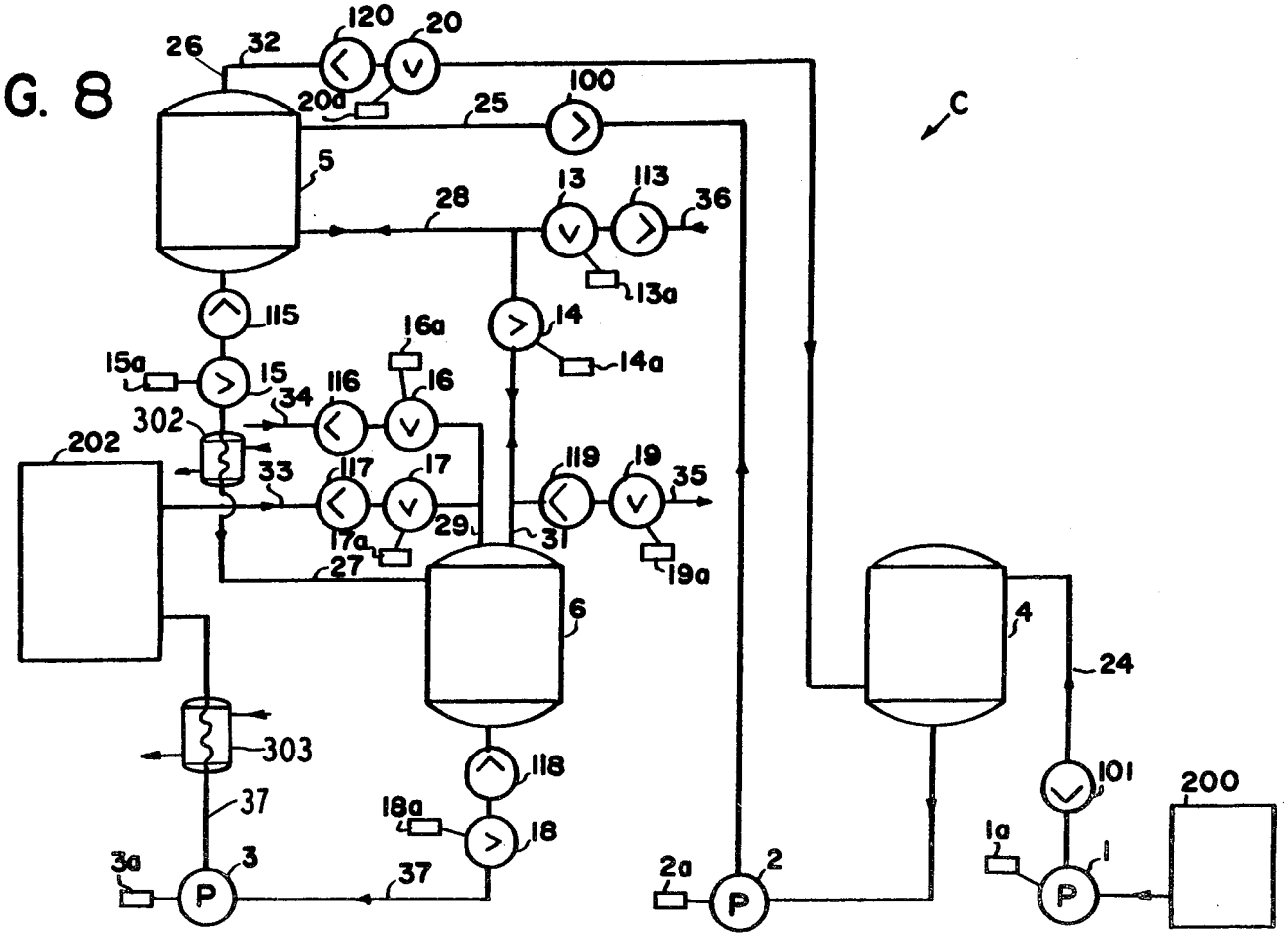
FIG. 8 is a view similar to that of FIGS. 1 and 5, illustrating a further form of the invention employing three of the indicated condensate receivers.

Referring to FIG. 8, the system C, is similar to that of FIG. 5 except that an additional receiver 4 that is arranged in the same manner as receiver 5, has been added. Line 32 in this embodiment connects line 26 at the top of receiver 5 to the lower portion of receiver 4 at its fitting which corresponds to fitting **28*a* of receiver 5. The pump 1 pumps condensate through the line 24 into the receiver 4 up to the primary liquid level of same. Line 24 contains check valve 101. A distributor 48 such as the one shown in FIG. 3 is used to distribute the vapor to heat the condensate in receiver 4. The vapor in receiver 5 is the left over vapor from the previous cycle when said receiver is drained and isolated. Valve 20 can be opened to release vapor from receiver 5 through the vapor distributor. The temperature of the condensate in receiver 4 may be raised, for example, from about 100 degrees F. to about 130 degrees F. The pump 2 in line 25 pumps condensate from vessel 4 to vessel 5 through check valve 100 and fitting 25*a*. Apart from these differences, the operation of the apparatus shown in FIG. 6 is the same as that described for the apparatus shown in FIG. 1**.

The operating systems shown in the drawings can be used in power plants or industrial plants. The selection of the specific arrangement employed should be based on the particular applications in each case. The word "condensate" refers to steam condensate or the condensate of any other vapor as the motive fluid, whenever it is applicable.

In the case of utilizing the method involved in the apparatus shown in FIG. 5 without the heat exchangers in a steam turbine fossil fuel power plant with a steam generator of 2,400 psig. pressure, steam is extracted from the turbines in six stages in which the steam temperature of the extract is approximately 150 degrees F., 190 degrees F., 240 degrees F., 380 degrees F., 460 degrees F., and 540 degrees F. During the operation, the vapor retained in the condensate receiver 6 should be approximately at 2,400 psig. pressure immediately after the receiver 6 is drained. Pump 1 can be used to pump condensate from a condenser, a deaerating tank, or a heat exchanger. For purposes of description, it is assumed that pump 1 is connected with condenser 200, and the pump 1 is to pump condensate at approximately 90 degrees F. from the condenser 200 into the receiver 5, up to the indicated predetermined water level **43*a*. A pre-set timer of float switch 1*a* is employed in the controls for pump 1 to shut off pump 1 when level 43*a* has been reached. Valve 13 represents three automatic valves in parallel and each valve with a check valve 113 is in separate piping. All three pipes are as shown as line 36; each pipe is connected to a source of steam extract. The first valve 13 is operated to release steam at 150 degrees F. into receiver 5 to heat the condensate in same up to approximately 130 dcgrees F., and the second valve 13 releases 190 degrees F. steam into receiver 5 to heat the condensate up to approximately 170 degrees F.; the third valve 13 releases steam at approximately 240 degrees F. to heat the condensate of receiver 5 up to approximately 215 degrees F.; then all the three valves 13 are closed. Valve 12 is open for approximately two to four seconds to release trapped air in the vessel 5** to the atmosphere.

Valve 14 is operated to release steam at not more than 2,400 psig. (received from generator 202 in previous cycle) from the receiver 6 into receiver 5 through a line 28, 31 and distributor 48, and this heats the condensate of vessel 5 up to approximately 300 degrees F. At this point, the vapor pressure in both receivers is balanced. While valve 14 remains open, in the form of FIG. 5, pump 2 pumps the condensate from receiver 5 into receiver 6. Valve 14 and pump 2 is shut off when the receiver 5 is drained.

Valve 16 represents three automatic valves 16 in parallel in the manner similar with valve 13. The lines 34 are connected to sources of steam extract. When the condensate has completely been transferred to receiver 6, and said receiver is isolated, the first valve 16 of this series is open to release steam of 380 degrees F. into vessel 6 to heat the condensate of receiver 6 up to approximately 340 degrees F., and the second valve releases steam of 460 degrees F. to heat the condensate up to approximately 420 degrees F. The third valve releases steam of 540 degrees F. to heat the condensate up to approximately 500 degrees F.; all three valves are then shut off. Such steam is released to the condensate through distributor 40 (FIG. 2).

Valve 17 is opened to release the superheat or saturate steam from the steam generator 200 at 2,400 psig. into the receiver 6 through distributor 40 and to raise the pressure in the receiver 6 up to approximately 2,400 psig. Valve 18 is then opened, and the pump 3 pumps the heated and pressurized condensate in receiver 6 into the steam generator 202, while valve 17 remains open. Valves 17, 18, and the pump 3 are shut off by a suitable pre-set timer arrangement immediately after the receiver 6 is drained. Valve 19 may be opened at this point for releasing a portion of the steam no present in the vessel 6 for use in supplying steam for other processing needs, and the valve 19 shall then be closed. Valve 20 may also be opened for approximately 2 to 4 seconds to release the steam in receiver 5 for outside process use immediately after the receiver 5 is drained. This operation reduces both the pressure in the receiver 5 and the horsepower requirements of pump 1 for the next cycle of the system. Valves 19 or 20 can be omitted when operation of the valve is not feasible in some cases.

In the indicated steam turbine power plant, the pump 1 in FIG. 5 can be connected to a deaerating tank instead of a condenser and a few condensate heaters can be installed in line 25 in series between the condenser and the deaerating tank.

Pump 1 can also be used to pump condensate from a series of heaters and receiver 5 is used to remove trapped air by opening the valve 12 for approximately 2 to 4 seconds. The rest of the operation is in accordance with the same principle as stated before.

The system shown in FIG. 5, 5A, 5B, and 5C, can be used in liquid transfer. The operation is similar to the example shown in the 2400 psig steam turbine power plant. The heating vapor can be steam in some cases and it can be the vapor of the liquid to be transferred into a pipe line, an apparatus with high pressure resistance, or a receiver at a high elevation. The heating vapor utilized is usually not more than 6 stages and it can be completely omitted in some cases, but the high pressure vapor released into receiver 6 (to build a pressure head therein) is essential in liquid transfer.

In a case, the apparatus shown in FIGS. 5, 5A, 6, and 7 is utilized in a steam turbine fossil power plant with a steam generator of 2,400 psig pressure, and steam is extracted from a turbine, the steam temperature of the extract is approximately 350° F. Valve 68 (FIG. 7) is opened to release the 350° F. steam extraction from turbine 208 to be heated to approximately 700° F. in reheat tube 77, and the steam is released into heat exchanger 302 to heat the condensate therein. Valve 67 (FIG. 6) is opened to release 280° F. extraction steam from turbine 208 to be heated to approximately 900° F. in reheat tube 74, and the steam is released to the heat exchanger 303 to heat the condensate therein. Pump 1 pumps the condensate at 230° F. from a deaerating tank into receiver 5 up to a primary liquid level and valve 14 is opened to release the high pressure vapor in receiver 6 into receiver 5 through a vapor distribution to heat the condensate up to approximately 290° F. Pump 2 pumps the condensate in receiver 5 into heat exchanger 302 and forces the heated condensate at approximately 380° F. in heat exchanger 302 into receiver 6 until receiver 5 is drained. Valve 17 is opened to release steam of 2,400 psig into receiver 6 from boiler 202. Valve 18 is opened and pump 3 pumps the condensate from receiver 6 into heat exchanger 303 to force the heated condensate at approximately 500° F. therein into vapor generator 202 directly or indirectly. The heating vapor used in heat exchanger 302,303 can be a kind of reheated vapor as in FIGS. 6, 7. It also can be regular vapor extractions from turbines as the convention practice. Heat exchangers 302 or 303 can represent one or more than one heat exchangers in series and vapor of various temperatures can be released into the heat exchangers in series, as in the conventional practice.

The discharged vapor from heat exchangers 302 and 303 may be the same pressure. It can be released to be cooled and condensed in combustion air heating coil 304, and the air is heated from 10° F. to 40° F. The coil serves as air heater and air cooled condenser (FIG. 6). It works both ways and thus it saves energy and equipment. The condensate in the coil can be charged into tank 200. The vapor can also be released to a heat exchanger to heat any kind of chemical or hot water to be used in air heating coil. It also can be released into a tank 200 through a vapor distributor therein to heat the condensate therein for example from 170° F. to 230° F. (FIG. 7).

The vapor is condensed in any arrangement described and thus the energy content of the vapor is conserved and the condensate can be returned to the generator. It is general knowledge that the efficiency of a pound of steam is higher in a power plant when it has more stages of reheat, especially when it is reheated by the heat flue in the boiler downstream from an economizer or from the last heating tube heated by the heat flue in the traditional practice. The vapor can be reheated in any adequate location, and it can be utilized the same way (in a tank, a heat exchanger or a coil) after it is discharged from a heat exchanger.

By way of example, an industrial plant, a boiler may generate 600 psig steam, and an apparatus may discharge 240° F. used steam and this steam is released in a heating tube which is located in the stream of waste heat in a flue of the boiler. The steam is heated to 600° F. and is used in a heat exchanger as shown in the invention to heat condensate from 300° F. to 400° F. and the discharged steam from the exchanger can be released into a deaerating tank to heat the condensate therein from 210° F. to 240° F. through a vapor distributor. The rest of the operation is similar to that in the power plant.

In a case of utilizing the system and apparatus involved shown in FIG. 10, in a power plant the condensate in the condensate sump 206 is 90° F. The two pressure vessels 5*e* and 5*f* are filled with steam. Pump 7 pumps the condensate from sump 206 into receiver 5*f* through a condensate distributor therein to fill the receiver to a substantial water level. Valve 66 is opened to release steam of 115° F. into the condensate in receiver 5*f* through a vapor distributor and raise the temperature of the condensate to approximately 110° F. The second valve 66 is opened to release steam of 150° F. into receiver 5 and raises the temperature of the condensate to approximately 145° F. Valve 64 is opened to release steam of 240° F. from receiver 5*e* into receiver 5*f*, through the vapor distributor and raises the condensate temperature to approximately 155° F. The third valve 66 is opened to release steam of 190° F. and to raise the condensate temperature to approximately 180° F. The fourth valve 66 is opened to release steam of 300° F. and to raise the condensate temperature up to approximately 270° F. Each valve stated is to be opened approximately 2 to 4 seconds and the valve is then closed. Now pump 10 starts to pump the condensate from receiver 5*f* into apparatus 207 (can be a deaerating tank or a storage tank) until receiver 5*f* is drained and the next cycle starts.

Valve 62 is opened to release the steam of approximately 160° F. from vessel 5*e* into the condensate in the sump 206 through the vapor distributor 206*a* to be condensed and valve 62 is closed after the vapor pressure in receiver 5*e* is about the same as it is in the condenser. The pump 8 starts to pump condensate from sump 206 into receiver 5*e*. Valve 62, distributor 206*a* and pipe 85 can be omitted when pump 8 is used. When these are not omitted, the pump 8 can be omitted if reciever 5*e* is lower than the sump 206 and the condensate from sump 206 can be drained into 5*e* by utilizing an automatic valve in line 80. The operation of the two receivers is the same in method. At least one open top sprinkler (FIGS. 3 and 4) is in operation where the condensate heating is in process. The sprinkler receives condensate through the condensate distributor in both the receivers. In this case, valves 65 or 66 represents 4 valves in parallel, and each valve has a separate pipe line and check valve.

The system shown in FIG. 10 is for utilizing heating vapor of lower temperature turbine extraction in a power plant, as compared to the conventional practice, and thus it releases vapor of comparatively high temperature to generate more power. The system also eliminates the costly multi-tube heat exchangers in conventional practice.

Referring to FIG. 11, a receiver 11 (which is a modification of FIG. 3) comprises a tank housing 705 which is adapted to receive liquid up to a primary liquid level 743*a*. Fluid line 26 or 29 connects into the top of the vessel 705 through fitting 26*a*, 29*a* (corresponding to connections similar to those described in connection with FIGS. 2 and 3). Bottom connection with lines 27 or 37 is effected through a fitting 27*a*, 37*a*. Suitably suspended from the inside of top wall 705*a* are one or more open top sprinkler devices 54 each of which, as previously described herein comprieses a trough having a multiplicity of holes 55. Extending across the interior of the vessel 705 above the primary liquid level 743*a* is a tubular distributor 746 having an all-over pattern of small distribution openings 747 which are in an array preferably entirely about the circumference of the distributor 746 so as to distribute condensate throughout the space above the liquid level 743*a* as and for the purpose previously described herein in connection with the receivers 5 and 6 (FIGS. 2 and 3). Condensate is delivered to the distributor 746 through line 25 or 27, attached to one end of the distributor through fitting 25*a* or 27*a*.

A multi-tube distributor 750 is located in the lower portion of the interior of the receiver 11 for releasing heating fluid through line 28 into the chamber. In this instance, the charging line 28 has a plurality of branches 28*a* and 28*b*. Branch 28*a* connects through a fitting 28*c* to a distributor 750, with two distributing tubes 750*a* and 750*b*. The tubes extend across the interior of the receiver 11 and has its opposite end sealed. Throughout its length and about its entire circumference, the tubes 750*a*, 750*b* have an array of relatively closely spaced distribution holes or ports 748 or 749, respectively, for injecting vapor into the liquid within the chamber 706.

Further improvement in attaining a high efficiency vapor condensing in the body of liquid in the chamber 706 is attained by means of at least one upper vapor distributor 751 which extends across the chamber 706 spaced above the distributor tube 750 and is connected to the branch 28*b* through fitting 28*d* and has its opposite ends sealed off. The distributor 751 has openings in the lower part of its circumference so that the vapor is injected from the distributor 751 downwardly to be mixed with the vapor injected from distributor 750 and thus it slows down the upward motion of the vapor in the lower level and it raises the efficiency of vapor condensing.

Figure 12:
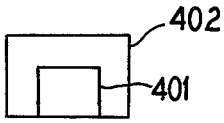
FIG. 12 illustrates a means for fire protection for a system for transferring combustible liquid, in accordance with the invention.

Referring to FIG. 12, the closed chamber 402 is filled with non-combustible gas such as nitrogen to prevent the explosion of any combustible fluid used in the system 401 according to the invention. The door of the chamber should be air tight. Any leakage of high pressure combustible gas can raise the pressure in the chamber. A pressure sensor set at 0.1" to 0.3" water column per square inch can be used to send out an alarm.

The liquid capacity of the vertical piping between receiver 5 and pump 2 and that between valve 118 and pump 3 shall be large enough to prevent the vapor in the pipe from getting into the pumps. The size of said vertical pipes can be enlarged. A liquid container can be installed at said vertical pipes instead of enlarging the pipe size.

The three-way valve 70 shown in FIG. 5*a*, is used for a controlled constant volume of condensate charged into vapor generator 202. This method can be also used in the system shown in FIG. 5*b* and FIG. 5*c*. Valve 71 shown in FIG. 5*a* remains open during operation to balance the vapor pressure in generator 202 and pressure vessel 204.

Timers can be used to control the operation of any automatic valve or any pump. Two timers can be used in parallel for any critical operation point. Whenever it is applicable, a float switch in any receiver or a flow switch downstream of any receiver can be used in parallel with related timers to stop the related pump operation. The control means for the various valves and pumps are schematically represented by similar respective reference characters with subscript a, i.e., 1*a*, 3*a*, 12*a*, 18*a*, etc.

The piping arrangement employed shall provide space for any piping or equipment thermal expansion.

In some cases where the condensate is available at adequate temperature and pressure, it can be released into one receiver through its distributor and controlled by a valve and timer. This saves the energy of pumping.

All the automatic valves in the system shall be opened at an adequate speed to prevent a harmful impact of the vapor or liquid. The piping arrangement shall minimize such impacts by using piping of adequate size and adequate length. The size of a distributor 40, 44, 46 and 48 shall be large enough to take any possible impact of high pressure fluid.

In some cases, when the heating vapor is released into the condensate in a vessel 5 or 6, a portion of the vapor reaches the top of the receiver and gradually builds up a vapor pressure. This pressure may slow down the process of releasing heating fluid. Open top sprinklers 54 as shown in FIGS. 2 to 4 can be used to reduce this vapor pressure. The said sprinklers are filled with comparatively cooler condensate through the condensate distribution of distributors 44, 46. Said sprinklers operate by gravity to sprinkle the condensate slowly through the small openings 55 at the bottom of the sprinklers (see FIG. 4). The sprinklers are in operation until the end of the heating vapor releasing into the related receiver 5 or 6. The comparatively cooler sprinkled condensate cools the indicated vapor that reaches the top of the receiver (5 or 6), and causes a portion of such vapor to be condensed; thus the pressure of such vapor is reduced. Whenever it is feasible, a motor forced sprinkler system can be used to replace the open top gravity sprinkler illustrated. In such case, a motor operated pump is used to pump comparatively cooler condensate from any adequate source into such sprinklers.

Except for air releasing piping, all equipment and piping that contains the condensate in the system shall be insulated to preserve energy.

In an exemplary case of an industrial plant condensate feeding system arranged in accordance with system B (FIG. 5), a 1,000 psig. steam boiler supplies all process steam to the plant. Almost all steam condensate is returned to the boiler room, and 40 percent of such condensate is at approximately 220 degrees F. when it reaches a condensate deaerating tank in the boiler room; such tank is connected with the suction side of pump 1 and equipped with a suitable air releasing valve and piping.

Two types of equipment in said plant discharge steam mixed with condensate and the discharge fluid temperature shall be 350 degrees F. and 450 degrees F.

When the system shown in FIG. 5 starts to operate, the pump 1 pumps the condensate from the deaerating tank into the receiver 5 up to the primary liquid level. Vavle 13 is open to release the said fluid of 350 degrees F. temperature into such receiver 5 through distributor 48, and to heat the condensate up to approximately 320 degrees F.; valve 13 is then closed. Valve 14 is opened to release not more than 1,000 psig. steam in the receiver 6 (the steam remained in the receiver from previous cycle) into the receiver 5 through the distributor 48, and the vapor pressure in the two receivers shall then be balanced. Pump 2 shall then pump the condensate in receiver 5 into the receiver 6, and both valve 14 and pump 2 shall then be shut off. Valve 16 is opened to release the fluid of 450 degrees F. through the distributor 40 of vessel 6 to heat the condensate in receiver 6 up to approximately 410 degrees F., and the valve 14, 16 shall then be shut off. The valves 19, 119, 12 and 112 remain closed, and the valve 20 is employed to release steam into the deaerating tank and to heat the condensate therein. The air releasing valve of such tank shall release air from the tank with adequate timing, by utilizing a timer to meet each particular requirement. The rest of the operation shall be the same as stated previously.

In a system there may be more than two receivers in series instead of the two receivers shown in FIGS. 1 and 5. Receivers 5 and 6 are interchangeable.

The vapor heated in the vapor reheat tubes as stated can be released into the vessels 5, 6 or 11 directly through at least one vapor distributor.

Generally, speaking, to transport the condensate by pumping is faster than by gravity drain. The receiver should be larger when the process timing is prolonged.

This invention is susceptible of many embodiments utilizing the principles herein described. To avoid prolixity, detailed description of many of the numerous possible embodiments has been omitted. However, FIGS. 8 and 9 are provided to show two additional embodiments.

FIG. 8 illustrates a system in which another receiver 4 and a pump are added to the system shown in FIG. 1. The receiver 4 is located upstream of the receiver 5 and the process between receiver 4 and receiver 5 is the same as it is between receivers 5 and 6 shown in FIG. 5.

Said receivers 4 and 5 are constructed in the way as shown in FIG. 3, but each receiver is built to meet its particular operating condition.

Figure 9:
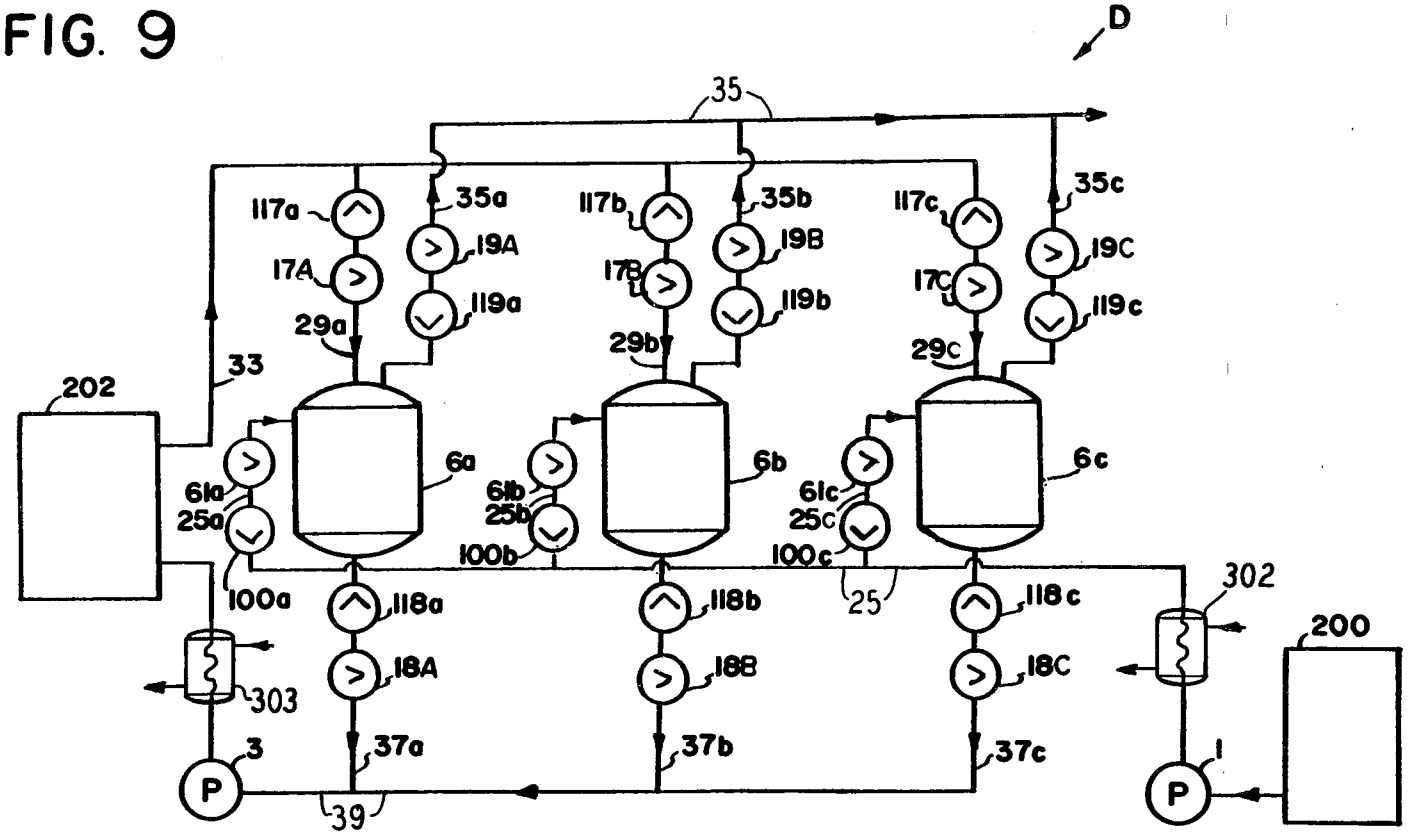
FIG. 9 is a view similar to that of FIG. 1 illustrating yet a further embodiment of the invention employing multiple pressure vessels.

FIG. 9 shows an arrangement that keeps pumps 2 and 3 in continuous operation. This involves the vapor generator 202 receiving the condensate continuously. In accordance with this arrangement at least two receivers are required, three receivers 6*a*, 6*b* and 6*c* are shown are for best operation, and such receivers are then operated in a rotational way to keep the pumps in operation continuously. Each of the receivers 6 operates in the same way as previously stated, and the indicated rotational sequence involves means that before the valve of one receiver 6 is closed, the identical valve of the other receiver 6, which is next in rotational order, shall be fully opened. Timers should be employed to control this operational feature involved. It is advisable to have a standby receiver 6 with the fittings required available. The control system can be arranged so that the standby receiver 6 is available for use to replace any of the receivers 6 being utilized.

A system which is similar to the one shown in FIG. 7 is to replace each of the receivers 6 with a two receiver system as shown in FIGS. 1 and 5.

The term "pump 3 pumps condensate into the vapor generator" includes all the ways that can be used to pump condensate into said generator 202 directly or indirectly. The indirect way means that the pump pumps the condensate into a pressure vessel and from that vessel the condensate is drained or pumped into the generator as shown In FIG. 5A. If the said vessel is used and the vessel has enough capacity of storage, the generator can receive a continuous condensate supply without using the suggested rotational methods described. Quite a number of minor changes may be employed as desirable or necessary, to meet a particular need but the basic principles of the methods herein disclosed are the same. The term high pressure vapor used in this disclosure includes all types of vapor utilized, which have at least 50 psig. operating pressure. The generator can be a heat exchanger or a boiler.

The piping and the valves used in accordance with the invention shall be such as to withstand the pressures and temperatures of the operational conditions encountered. Stainless steel can be used in a delicate rust free operation. Steel pipe manufacturers provide all particular details for any particular requirement.

The term "generator", "a pump", "a tank", and "a receiver" as used hereing indicates at least one of such equipment, but these terms are not limited to mean just one equipment component thereof.

When a distributor is used to distribute relatively cool condensate into a receiver, said condensate can cool the relatively hotter vapor therein, and thus the vapor is cooled and the vapor pressure is immediately reduced. This operation is used to reduce he condensate pumping energy by reducing the pump pressure head requirements.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What I claim is:

1. A high efficiency energy saving condensate feeding system for feeding condensate into a high pressure vapor generator of more than 85 psig vapor pressure, comprising:

a first and a second energy saving high pressure vessel filled with the same kind of vapor as is generated by said generator and said vapor in said first vessel being high pressure vapor of which most of the energy content is to be restored to said generator;

means for charging condensate into said second vessel to fill said second vessel up to a substantial liquid level in said second vessel;

means for selectively isolating said second vessel;

at least two levels of high pressure vapor distributing tubes with multiple openings under said liquid level in said second vessel, and some of the openings of said tube at upper level are directed to inject vapor to lower level to slow down the upward motion of a portion of vapor released from a vapor distributing tube at lower level for effective vapor condensing;

means for releasing said high pressure vapor in said first vessel into said second vessel and to inject said vapor from said vapor distributing tubes at various elevations into the condensate in said second vessel for reducing the vapor pressure by condensing a portion of said vapor and to preserve the energy content of said condensed vapor;

means for charging said condensate from said second vessel into said first vessel;

means for isolating said first vessel from said second vessel;

means for bleeding high pressure vapor from said high pressure vapor generator into said first vessel to build up a pressure head in said first vessel for assisting condensate feeding into said generator;

means for charging said condensate from said first vessel into said generator until said first vessel is selectively drained while said vapor bleeding means is selectively in operation;

and means for selectively isolating said first vessel from said high pressure vapor generator.

2. A system according to claim 1, comprising a condensate distributor with multiple openings disposed in said second vessel, and means for charging relatively cooler condensate into said second vessel and to inject said condensate through said multiple openings of said condensate distributor into the vapor in said second vessel to condense a portion of said vapor for reducing the vapor pressure.

3. A system according to claim 1, comprising a condensate distributor with multiple openings disposed in said first vessel, and means for charging relatively cooler condensate from said second vessel into said first vessel and to inject said condensate into said vapor in said first vessel through said multiple openings of said condensate distributor to condense a portion of said vapor for reducing the vapor pressure.

4. A system according to claim 3, comprising a condensate distributor with multiple openings disposed in said second vessel, and means for charging relatively cooler condensate into said second vessel and to inject said condensate into said vapor in said second vessel through said multiple openings of said condensate distributor to condense a portion of said vapor for reducing the vapor pressure.

5. A system according to claim 1, including at least one valved releasing line leading from a source of used process vapor to at least one of said pressure vessels, a vapor distributor with multiple openings under the liquid level in said one vessel, valve means in said used vapor releasing line for releasing said used process vapor into said one pressure vessel and to inject said vapor into the condensate therein through said vapor distributor for preserving most of the latent heat of said used process vapor by condensing most of said vapor in said condensate, after said one vessel is charged with condensate.

6. A system according to claim 5, including, sprinkler means in the top portion of said one vessel for sprinkling relatively cooler condensate to cool the vapor above the condensate liquid level in said one vessel for reducing the vapor pressure in said one vessel while said used process vapor is injected into said condensate.

7. A system according to claim 5, including a condensate distributor in said one vessel, and at least one open top gravity operated sprinkler in the top portion of said one vessel for receiving relatively cooler condensate distributed by said condensate distributor, said sprinkler being adapted for sprinkling relatively cooler condensate to reduce the vapor pressure above the liquid level in said one vessel, while said vessel is subjected to said used vapor releasing.

8. A system according to claim 7, wherein said condensate distributor has multiple openings for shower distribution of the condensate therefrom to cool the top portion of said vessel.

9. A system according to claim 1, including a third pressure vessel, a condensate communication line leading from said third vessel to said second vessel, a vapor pressure balancing line leading from second vessel to said third vessel, means for charging condensate into said third vessel up to a substantial liquid level, a vapor distributor in said third vessel, means in said balancing line for releasing vapor from said second vessel into said third vessel through said vapor distributor for injecting said vapor into the condensate in said third vessel to condense a portion of said vapor, means for feeding condensate from said third vessel into the second vessel through said communication line.

10. A pressure vessel capable of withstanding over 100 psig internal operating pressure, said vessel comprising:

a pressure resisting shell defining a pressure chamber having therein a substantial liquid level;

at least two levels of high pressure vapor distributing tubes with multiple openings under said liquid level, deposed in said shell and connected to at least one opening in said shell and adequate to withstand impact of high pressure vapor and at least one said vapor distributing tube above a lower vapor distributing tube, and having openings at the lower part of said upper distributing tube for injecting vapor downwardly for mixing said injected vapor with the vapor released from the lower distributing tube when said vessel is filled with liquid up to said liquid level;

whereby said injected vapor slows down the upward motion of a portion of said released vapor from said lower distributing tube for effectively condensing a portion of said released vapor.

11. A condensate receiver functioning as an energy saving high pressure vessel capable of withstanding over 100 psig internal operating pressure, said vessel comprising:

a pressure resisting shell defining a pressure chamber;

at least one high pressure vapor distributor with at least one elongate substantially straight vapor distributing tube disposed in said chamber, adequate to withstand impact of 100 psig high pressure vapor and connected to an opening in said shell;

and said vapor distributing tube having multiple openings below the liquid level in said chamber for injecting and substantially distributing vapor of more than 100 psig pressure into the condensate in said chamber and said openings being adequate to withstand the friction of said high pressure vapor injecting, and said liquid level being the liquid level at the time that the vapor distributor starts operation;

at least one condensate distributor with at least one elongate substantial distributing tube disposed in said chamber and connected to an opening in said shell, and having multiple openings for injecting a spray shower of relatively cooler condensate into the high pressure vapor in said chamber to reduce the vapor pressure therein for energy conservation and some of said openings being directed toward the top portion of said shell for impinging the condensate onto the top portion of said shell for cooling said top portion of said shell to prevent heating vapor in said shell by said top portion of said shell.

12. A pressure vessel according to claim 11, including at least one fluid distributor having multiple openings under liquid level in said chamber for releasing and injecting condensate from an external source into relatively cooler condensate in said chamber for energy conservation.

13. A pressure vessel according to claim 11, wherein said vapor distributor and said condensate distributor are connected to respective supply lines having slow opening automatic valves therein; and an adjustable preset timer connected to each of said valves for operating each of said valves.

14. A pressure vessel according to claim 11, wherein said vapor distributor comprises more than one high pressure tubular member extending substantially horizontally within said chamber.

15. A pressure vessel according to claim 11, including condensate sprinkler means in the top of said chamber for reducing vapor pressure above said liquid level in said chamber while said high pressure vapor distributor is in operation.

16. A condensate receiver functioning as an energy saving pressure vessel, said vessel comprising:

a pressure resisting shell defining a pressure chamber;

at least one vapor distributor disposed in said chamber an attached to an opening in said shell;

and said distributor having multiple openings below a substantial liquid level in said chamber for injecting relatively higher pressure vapor into the condensate in said chamber and said liquid level being the liquid level at the time that the vapor distributor starts to operate;

at least one high pressure condensate distributor with multiple openings disposed in said chamber and attached to an opening in said shell for injecting a spray shower of relatively cooler condensate into high pressure vapor in said chamber to reduce the vapor pressure;

and at least one open top gravity operated condensate sprinkler means in the upper portion of said chamber and the location of the top opening of said sprinkler being located for receiving a volume of sprayed condensate from said condensate distributor.

17. A high efficiency energy saving method for feeding condensate into a high pressure vapor generator of more than 85 psig vapor pressure, comprising:

providing first and second energy saving high pressure vessels, having high efficiency multi-elevation vapor distributing tubes with multiple openings disposed in said second vessel and filling said vessels with the same kind of vapor as is generated by said generator, and the vapor in said first vessel being high pressure vapor of which at least most of the energy content is to be restored to the system;

charging condensate into said second vessel and filling the second vessel up to a substantial liquid level in said second vessel;

selectively isolating said second vessel;

releasing said high pressure vapor in said first vessel into said second vessel and injecting said high pressure vapor into the condensate in said second vessel through said vapor distributing tubes with multiple openings under the liquid level in said second vessel and thereby reducing the vapor pressure by condensing a portion of said vapor and preserving the energy content of said condensed vapor;

charging said condensate from said second vessel into said first vessel;

isolating said first vessel selectively from said second vessel;

bleeding high pressure vapor from a high pressure vapor source into said first vessel and building up a pressure head in said first vessel for assisting condensate feeding into said generator;

charging said condensate from said first vessel into said generator until said first vessel is selectively drained while said vapor bleeding is selectively in operation; and selectively isolating said first vessel from said high pressure vapor source.

18. A method according to claim 17, which comprises charging relatively cooler condensate into said second vessel through a condensate distributor with multiple openings disposed in said second vessel; and injecting said condensate through said openings into said vapor in said second vessel and thereby reducing the vapor pressure by condensing a portion of said vapor.

19. A method according to claim 17, which comprises charging said condensate from said second vessel into said first vessel through a condensate distributor with multiple openings disposed in said first vessel; and injecting said condensate through said openings into said vapor in said first vessel and thereby reducing the vapor pressure by condensing a portion of said vapor.

20. A method according to claim 19, which comprises charging relatively cooler condensate into said second vessel through a condensate distributor with multiple openings disposed in said second vessel, and injecting said condensate through said openings into said vapor in said second vessel and thereby reducing the vapor pressure by condensing a portion of said vapor.

21. The method according to claim 17, comprising partially releasing vapor from said first vessel for process work outside of said first vessel immediately after said first vessel is drained and isolated.

22. A method according to claim 17, comprising partially releasing vapor from said second vessel for outside process work immediately after said first vessel is drained and isolated.

23. A method according to claim 17, comprising releasing used process vapor into the condensate of at least one of said vessels through a vapor distributor therein with multiple openings; and thereby condensing most of said vapor in said condensate for preserving the latent heat of said condensed used vapor.

24. A method according to claim 17, comprising releasing condensate of relatively high temperature into the condensate in one of said vessels through a fluid distributor with multiple openings therein; and thereby heating the condensate in said one vessel.

25. A method according to claim 23, comprising sprinkling relatively cooler condensate from at least one condensate sprinkler in the top of one of said vessels, and thereby cooling vapor in said one vessel and reducing the vapor pressure in said one vessel, during said used vapor releasing.

26. A method according to claim 23, which comprises releasing said used vapor into said one vessel through at least one vapor distributor therein from different vapor sources of different temperatures and such releasing being in multiple stages.

27. A method according to claim 17, comprising charging said condensate from said first vessel into an additional pressure vessel, and then charging condensate from said additional pressure vessel into said vapor generator.

28. A method according to claim 27, comprising charging condensate into said generator from said pressure vessel at approximately a predetermined constant speed as a non-stop continuous operation.

29. A method according to claim 17, comprising effecting all the operations, except charging condensate into said second vessel and pumping, by opening an automatic valve for fluid releasing and closing one or two automatic valves for said isolating, controlling each valve by means of a respective adjustable preset timer connected thereto.

30. A method according to claim 23, comprising operating at least two sets of said vessels in an order of rotation, and thereby maintaining continuous releasing of said used vapor into said vessels.

31. A method according to claim 17, comprising operating at least two sets of said vessels in an order of rotation, and thereby maintaining continuous condensate feeding to said generator from said vessels.

32. A method according to claim 17, which comprises bleeding vapor from said high pressure vapor source into the condensate in said first vessel through a vapor distributor therein with multiple openings and thereby heating said condensate and imposing a pressure head in said first vessel.

33. A method according to claim 25, which comprises sprinkling condensate from at least one open top sprinkler in the top of said one vessel for reducing the vapor pressure above the liquid level in said one vessel.

34. A method according to claim 17, including providing a third pressure vessel in series with said second vessel, charging condensate into said third vessel to fill same up to a substantial liquid level in said third vessel, releasing and injecting vapor from said second vessel into said condensate in said third vessel through a vapor distributor with multiple openings to condense a portion of said vapor in said condensate; and charging said condensate from said third vessel into said second vessel.

35. A method according to claim 17, which comprises bleeding superheated vapor into said first vessel from said high pressure vapor source to build up said vapor head.

36. An energy saving method for feeding condensate to a condensate deaerating tank, comprising:

providing a condenser with a condenser sump, and a pressure vessel;

filling said pressure vessel with the same kind of vapor as it is in the condenser;

charging condensate into said vessel from said condenser sump and filling said pressure vessel up to a substantial liquid level in said vessel;

selectively isolating said vessel;

releasing multi-stages of vapor of various temperatures into said vessel through a vapor distributor with multiple openings under the liquid level in said vessel and thereby condensing most of said vapor and heating the condensate for raising its vapor pressure;

and selectively charging said condensate in said vessel into said deaerating tank.

37. A method according to claim 36, wherein the heating vapor is used vapor.

38. A high efficiency energy saving method for feeding liquid into an apparatus with more than 15 psig internal pressure, comprising:

providing first and second energy saving high pressure vessels and filling said vessels with the same kind of vapor, and the vapor in said first vessel being high pressure vapor of which at least most of the energy content is to be restored to the system;

charging said liquid into said second vessel and filling the second vessel up to a substantial liquid level in said second vessel;

selectively isolating said second vessel;

releasing said high pressure vapor in said first vessel into said second vessel and injecting said high pressure vapor into the liquid in said second vessel through a vapor distributor with multiple openings under the liquid level in said second vessel and thereby reducing the vapor pressure and condensing most of said released vapor and preserving the energy content of said condensed vapor;

charging said condensate from said second vessel into said first vessel;

isolating said first vessel selectively from said second vessel;

bleeding high pressure vapor from a high pressure vapor source into said first vessel and building up a pressure head in said first vessel for assisting condensate feeding into said apparatus;

charging said liquid from said first vessel into said apparatus until said first vessel is selectively drained while said vapor bleeding is selectively in operation; and selectively isolating said first vessel from said high pressure vapor source.

39. A high efficiency energy saving method for feeding liquid into a pipe line with more than 40 psig internal friction pressure resistance during said liquid feeding, comprising:

providing first and second energy saving high pressure vessels and filling said vessels with the same kind of vapor, and the vapor in said first vessel being high pressure vapor of which at least most of the energy content is to be restored to the system;

charging said liquid into said second vessel and filling the second vessel up to a substantial liquid level in said second vessel;

selectively isolating said second vessel;

releasing said high pressure vapor in said first vessel into said second vessel and injecting said high pressure vapor into the liquid in said second vessel through a vapor distributor with multiple openings under the liquid level in said second vessel and thereby reducing the vapor pressure and condensing most of said vapor and preserving the energy content of said condensed vapor;

charging said liquid from said second vessel into said first vessel;

isolating said first vessel selectively from said second vessel;

bleeding high pressure vapor from a high pressure vapor source into said first vessel and building up a pressure head in said first vessel for assisting liquid feeding into said pipe line;

charging said liquid from said first vessel into said pipe line until said first vessel is selectively drained while said vapor bleeding is selectively in operation; and selectively isolating said first vessel from said high pressure vapor source.

40. A high efficiency energy saving method for feeding liquid into a liquid receiver at more than 50 feet in elevation above the liquid source, comprising:

providing first and second energy saving high pressure vessels and filling said vessels with the same kind of vapor, and the vapor in said first vessel being high pressure vapor of which at least most of the energy content is to be restored to the system;

charging said liquid from said liquid source into said second vessel and filling the second vessel up to a substantial liquid level in said second vessel;

selectively isolating said second vessel;

releasing said high pressure vapor in said first vessel into said second vessel and injecting said high pressure vapor into the liquid in said second vessel through a vapor distributor with multiple openings under the liquid level in said second vessel and thereby reducing the vapor pressure and condensing at least a portion of said released vapor and preserving the energy content of said condensed vapor;

charging said liquid from said second vessel into said first vessel;

isolating said first vessel selectively from said second vessel;

bleeding high pressure vapor from a high pressure vapor source into said first vessel and building up a pressure head in said first vessel for assisting liquid feeding into said liquid receiver;

charging said liquid from said first vessel into said liquid receiver until said first vessel is selectively drained while said vapor bleeding is selectively in operation; and selectively isolating said first vessel from said high pressure vapor source.

41. A high efficiency energy saving method for feeding condensate into a high pressure vapor generator of more than 100 psig vapor pressure, comprising:

providing a heat exchanger, a first and a second energy saving high pressure vessels and filling said vessels with the same kind of vapor as is generated by said generator, and the vapor in said first vessel being high pressure vapor of which at least most of the energy content is to be restored to the system, and said condensate is in said heat exchanger to be heated;

releasing heating vapor into said heat exchanger to heat the condensate therein;

charging condensate into said second vessel and filling the second vessel up to a substantial liquid level in said second vessel;

selectively isolating said second vessel;

releasing said high pressure vapor in said first vessel into said second vessel and injecting said high pressure vapor into the condensate in said second vessel through a vapor distributor with multiple openings under the liquid level in said second vessel and thereby reducing the vapor pressure and condensing a portion of said vapor and preserving the energy content of said condensed vapor;

charging said condensate from said second vessel into said heat exchanger and forcing at least a portion of the heated condensate therein into said first vessel;

isolating said first vessel selectively from said second vessel;

bleeding high pressure vapor from a high pressure vapor source into said first vessel and building up a pressure head in said first vessel and thereby assisting condensate feeding into said generator;

charging said condensate from said first vessel into said generator until said first vessel is selectively drained while said vapor bleeding is selectively in operation; and selectively isolating said first vessel from said high pressure vapor source.

42. A method according to claim 41, wherein at least two heat exchangers in series filled with condensate are utilized in place of one heat exchanger, releasing heating vapor to said series of heat exchangers and heating the condensate therein, charging condensate from said second vessel into said series of heat exchangers and forcing at least a portion of the heated condensate therein into said first vessel.

43. A method according to claim 41, comprising a vapor reheat tube filled with said heating vapor to be heated in the heat flue of a boiler downstream of the conventional vapor generating tube of the boiler, and releasing vapor from said reheat tube into said heat exchanger to heat the condensate therein.

44. A method according to claim 41, comprising a vapor reheat tube filled with said heating vapor to be heated in the heat flue of a boiler downstream of an economizer of the boiler and releasing vapor from said reheat tube into said heat exchanger to heat the condensate therein.

45. A method according to claim 41, in which at least a portion of the heating vapor is not condensed in said heat exchanger after heating the condensate therein, releasing the used vapor in said heat exchanger into a boiler combustion air heating coil for heating said combustion air and for condensing at least most of said vapor, and thus preserving the energy content of the condensed vapor.

46. A method according to claim 41, in which at least a portion of the heating vapor is not condensed in said heat exchanger after heating the condensate therein, releasing the used vapor in said heat exchanger into a condensate tank through a vapor distributor to condense most of said vapor into the condensate with relatively lower temperature in said tank.

47. A method according to claim 42, in which at least a portion of the heating vapor is not condensed in said heat exchangers after heating the condensate therein, releasing at least a portion of the used vapor from at least one of the heat exchangers into a boiler combustion air heating coil for heating said combustion air and for condensing at least a portion of the said heating vapor.

48. A high efficiency energy saving method for feeding condensate into a high pressure vapor generator of more than 100 psig vapor pressure, comprising:

providing at least two heat exchangers, a first and a second energy saving high pressure vessel and filling said vessels with the same kind of vapor as is generated by said generator, and the vapor in said first vessel being high pressure vapor of which at least most of the energy content is to be restored to the system, and said condensate is in said heat exchangers to be heated;

releasing heating vapor into said heat exchangers to heat said condensate therein;

charging condensate into said second vessel and filling the second vessel up to a substantial liquid level in said second vessel;

selectively isolating said second vessel;

releasing said high pressure vapor in said first vessel into said second vessel and injecting said high pressure vapor into the condensate in said second vessel through a vapor distributor with multiple openings under the liquid level in said second vessel and thereby reducing the vapor pressure and condensing a portion of said vapor and preserving energy content of said condensed vapor;

charging said condensate from said second vessel into at least one of said heat exchangers and forcing at least a portion of the condensate from said one exchanger into said first vessel;

isolating said first vessel selectively from said second vessel;

bleeding high pressure vapor from a high pressure vapor source into said first vessel and building up a pressure head in said first vessel for assisting condensate feeding into said heat exchanger;

charging said condensate from said first vessel into at least one said heat exchanger and forcing the condensate therein into said generator until said first vessel is selectively drained while said vapor bleeding is selectively in operation; and selectively isolating said first vessel from said high pressure vapor source.

49. A method according to claim 48, in which at least most of the heating vapor is not condensed in said heat exchangers, charging at least a portion of said used heating vapor from at least one of said heat exchangers into a boiler combustion air heating coil for heating the combustion air and for condensing at least a portion of the heating vapor.

50. A high efficiency energy saving method for feeding condensate into a high pressure vapor generator of more than 100 psig vapor pressure, comprising:

providing a heat exchanger, a first and a second energy saving high pressure vessel and filling said vessels with the same kind of vapor as is generated by said generator, and the vapor in said first vessel being high pressure vapor of which at least most of the energy content is to be restored to the system and said condensate is in said heat exchanger to be heated;

releasing heating vapor into said heat exchanger to heat the condensate therein;

charging condensate into said second vessel and filling the second vessel up to a substantial liquid level in said second vessel;

selectively isolating said second vessel;

releasing said high pressure vapor in said first vessel into said second vessel and injecting said high pressure vapor into the condensate in said second vessel through a vapor distributor with multiple openings under the liquid level in said second vessel and thereby reducing the vapor pressure and condensing a portion of said vapor and preserving the energy content of said condensed vapor;

charging said condensate from said second vessel into said first vessel;

isolating said first vessel selectively from said second vessel;

bleeding high pressure vapor from a high pressure vapor source into said first vessel and building up a pressure head in said first vessel for assisting condensate feeding into said heat exchanger;

charging said condensate from said first vessel into said heat exchanger and forcing at least a portion of said heated condensate therein into said generator until said first vessel is selectively drained while said vapor bleeding is selectively in operation; and selectively isolating said first vessel from said high pressure vapor source.

51. A method according to claim 50, wherein at least two heat exchangers in series filled with condensate are utilized in place of one heat exchanger, releasing heating vapor to said series of heat exchangers and heating the condensate therein, charging condensate from said first vessel into said series of heat exchangers and forcing at least a portion of the heated condensate therein into said generator.

52. A method according to claim 50, comprising a vapor reheat tube filled with said released vapor to be heated in the heat flue of a boiler downstream of the conventional vapor generating tubes of the boiler and releasing said vapor from said reheat tube into said heat exchanger to heat the condensate therein.

53. A method according to claim 50, comprising a vapor reheat tube filled with said release vapor to be heated in the heat flue of a boiler and releasing said vapor from said reheat tube into said heat exchanger to heat the condensate therein.

54. A method according to claim 50, in which at least a portion of said heating vapor is not condensed in said heat exchanger after heating the condensate therein, releasing the used vapor from said heat exchanger into a boiler combustion air heating coil for heating said combustion air and for condensing at least a portion of said vapor, and thus preserving the energy content of the condensed vapor.

55. A method according to claim 50, in which at least a portion of said heating vapor is not condensed in said heat exchanger after heating the condensate therein, releasing the used vapor from said heat exchanger into a condensate tank through a vapor distributor to condense most of said vapor into the condensate with relatively lower temperatures in said tank and thus preserving the energy content of said condensed vapor.

56. A method according to claim 51, in which at least a portion of said heating vapor is not condensed in said heat exchangers after heating the condensate therein, releasing at least a portion of the used vapor from at least one of the heat exchangers into a boiler combustion air heating coil for heating said combustion air and for condensing at least a portion of the said heating vapor.

57. A method according to claim 36, including another pressure vessel as second pressure vessel filled with relatively cooler condensate up to a substantial liquid level to be operated in parallel with the first pressure vessel, releasing the vapor remaining in the first vessel into said second vessel through a vapor distributor with multiple openings under said liquid level in said second vessel and thereby condensing at least a portion of said vapor after said condensate is selectively charged into said tank.

58. A method according to claim 36, including a vapor distributor in said condenser sump, releasing said vapor remaining in said vessel into the liquid in said sump through said vapor distributor with multiple openings under the liquid level of the condenser for condensing at least a portion of said vapor, after said condensate in said vessel is selectively charged into said tank.

59. A high efficiency energy saving method for feeding liquid into a pipe line with more than 40 psig internal friction pressure resistance during said liquid feeding, comprising:

providing an energy saving high pressure vessel and filling said vessel with vapor;

charging said liquid into said vessel and filling said vessel up to a substantial liquid level in said vessel;

selectively isolating said vessel;

bleeding high pressure vapor from a high pressure vapor source into said vessel and building up a pressure head in said vessel for assisting liquid feeding into said pipe line;

charging said liquid from said vessel into said pipe line until said vessel is selectively drained while said vapor bleeding is selectively in operation;

selectively isolating said vessel from said high pressure vapor source; and releasing at least a portion of the vapor in said vessel for heating and energy conservation.

60. A high efficiency energy saving method for feeding liquid into an apparatus with more than 30 psig internal pressure resistance during said liquid feeding, comprising:

providing an energy saving high pressure vessel and filling said vessel with vapor;

charging said liquid into said vessel and filling said vessel up to a substantial liquid level in said vessel;

selectively isolating said vessel;

bleeding high pressure vapor from a high pressure vapor source into said vessel and building up a pressure head in said vessel for assisting liquid feeding into said apparatus;

charging said liquid from said vessel into said apparatus until said vessel is selectively drained while said vapor bleeding is selectively in operation;

selectively isolating said vessel from said high pressure vapor source; and releasing at least a portion of the vapor in said vessel for heating and energy conservation.

61. A high efficiency energy saving method for feeding liquid into a receiver at more than 20 feet in elevation above the liquid source, comprising:

providing an energy saving high pressure vessel and filling said vessel with vapor;

charging said liquid into said vessel and filling said vessel up to a substantial liquid level in said vessel;

selectively isolating said vessel;

bleeding high pressure vapor from a high pressure vapor source into said vessel and building up a pressure head in said vessel for assisting liquid feeding into said receiver;

charging said liquid from said vessel into said receiver until said vessel is selectively drained while said vapor bleeding is selectively in operation;

selectively isolating said vessel from said high pressure vapor source; and releasing at least a portion of the vapor in said vessel for heating and energy conservation.

62. An energy saving method to feed liquid into a high pressure apparatus of more than 50 psig vapor pressure comprising:

providing at least two energy saving high pressure vessels the first and the second pressure vessels to be operated in parallel, and filling said vessels with the same kind of vapor, and the vapor in said second vessel being high pressure vapor;

charging liquid into said first vessel and filling liquid into said first vessel up to a substantial liquid level in said first vessel;

selectively isolating said first vessel;

releasing said high pressure vapor from said second vessel into the liquid in said first vessel through a vapor distributor with multiple openings under said liquid level in said first vessel and thereby condensing a portion of said vapor and reducing the vapor pressure;

releasing high pressure vapor from a high pressure vapor source into said first vessel to impose a pressure head in said first vessel;

selectively charging said liquid from said first vessel into said apparatus while said high pressure vapor releasing is selectively in operation;

selectively isolating said first vessel from said apparatus and said high pressure vapor source;

charging liquid into said second pressure vessel up to a substantial liquid level in said second vessel;

releasing said vapor from said first vessel into the liquid in said second vessel through a vapor distributor with multiple openings under said liquid level in said second vessel and thereby reducing the vapor pressure and condensing a portion of said vapor;

then selectively isolating said first vessel from said second vessel;

releasing high pressure vapor from a high pressure vapor source into said second vessel and imposing a pressure head in said second vessel;

selectively charging said liquid from said second vessel into said apparatus while said high pressure vapor releasing is selectively in operation;

and then selectively isolating said second vessel from said high pressure vapor source and said apparatus.

63. A method according to claim 62 comprising, releasing at least one stage of heating vapor into said liquid at least one of said pressure vessels to heat the liquid therein after said vessel is filled with said liquid up to said substantial liquid level in said one vessel.

* * * * *